United States Patent [19]

Robbi

[11] 4,011,464

[45] Mar. 8, 1977

[54] LOW ENERGY SWITCHING CIRCUIT

[75] Inventor: Anthony Drea Robbi, Hopewell, N.J.

[73] Assignee: RCA Corporation, New York, N.Y.

[22] Filed: June 6, 1975

[21] Appl. No.: 584,379

[52] U.S. Cl. ..... 307/137; 321/15

[51] Int. Cl.[2] ..... H01H 1/50; H01H 1/60

[58] Field of Search ..... 307/137, 247 A, 136, 307/138, 108; 321/15

[56] References Cited

UNITED STATES PATENTS 3,233,118 2/1966 Jensen ..... 307/247 A 3,860,833 1/1975 Tyau ..... 307/247 A

*Primary Examiner*—David Smith, Jr.

*Attorney, Agent, or Firm*—Edward J. Norton; Carl M. Wright

[57] ABSTRACT

Switch for use in low energy circuit and which is arranged to switch a larger voltage than required by driven circuits to insure breakdown of insulating film on switch contacts.

3 Claims, 3 Drawing Figures

LOW ENERGY SWITCHING CIRCUIT

BACKGROUND OF THE INVENTION

Low energy switching is unreliable unless special precautions are taken to insure the breakdown of an insulating film that forms on the surface of the switch contacts. In the prior art, redundant contacting in each switch is provided, and, sometimes, a double wipe contact may be used with high contact pressure to insure that when a switch is closed, the insulating film which tends to form over the contact will break down, thereby insuring conduction. (See, e.g., AMF MA-012-DW Series switches.)

Input circuits such as CMOS logic circuits require extremely small currents at low voltages so that activating an input switch does not always result in a reliable contact being made because the insulating film, which may be due to oxidation of the contact surface, is not broken down by the extremely low energy being switched.

Another prior art solution is to use a constant current generator to provide higher energy through the switch contacts. This, however, increases the cost of providing input switching. Also, switching contacts have been designed so that, when the switch is closed, the contact area is small which increases the closure current density to aid film breakdown.

The invention described herein provides an inexpensive circuit for insuring the breakdown of the insulation layer on an inexpensive switch used in low energy applications by placing a high voltage across the switch and yet maintaining the desired output voltage swing.

SUMMARY OF THE INVENTION

A switch, selectively operable to couple first and second terminals electrically, is coupled via an impedance from one switch terminal to an output terminal, the output terminal also being connected via a resistance to a first voltage level. The other terminal of the switch is coupled to a second voltage level which is lower than the first. The output terminal is coupled to a third voltage level intermediate the first and second voltage levels by a diode coupled to conduct current so that the voltage level at the output terminal does not fall below the third voltage level.

DETAILED DESCRIPTION OF THE INVENTION

Figure 1:
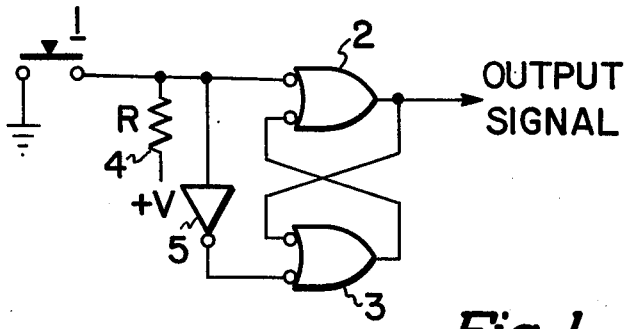
FIG. 1 is a logic diagram showing a circuit in which the invention would be useful.

In FIG. 1, a single pole, single throw switch 1 couples when activated, a low voltage representing a logical zero to a flip-flop comprised of cross-coupled NAND gates 2 and 3. When the switch is in the open position, the higher voltage, +V, representing a logical one, is coupled via a resistor 4 to the input of the NAND gate 2. The logical one signal at the input of the NAND gate 2 is converted to a logical zero signal and coupled to an input of the NAND gate 3 via an inverter 5. The other input signal to the NAND gate 2 is presumed, at this point, to be a logical one. The operation of the circuit of FIG. 1 is as follows. The logical one signals on both inputs of the NAND gate 2 cause the output voltage from the NAND gate 2 to be a logical zero signal. The corresponding logical zero output signal of the inverter 5 forces a logical one output signal from the NAND gate 3 which is coupled to the NAND gate 2. This represents one stable state of the circuit. When the switch is closed, the resistor 4 is coupled between ground and a positive voltage which causes a current to flow through the resistor 4, making the input signal to the NAND gate 2 a logical zone which forces the output signal to a logical one.

The logical one output signal from the NAND gate 2 is coupled to an input of the NAND gate 3. The output signal from the inverter 5 is now a logical one signal. The two logical one input signals force the output signal from the NAND gate 3 to logical zero signal which is coupled to the other input of the NAND gate 2 and maintains the output signal from the NAND gate 2 at a logical one despite minor input signal fluctuations (or "grass") due to contact bounce in the switch 1.

COS/MOS (Complementary Symmetry Metal Oxide Silicon) type logic gates draw input currents measured in nanoamperes. Consequently, COS/MOS systems are used with low current capacity power supplies so that a large current impulse cannot be delivered. This limits the minimum value of the resistor 4 in FIG. 1. As a result, the energy switched by the switch 1, i.e., the integral of the product of the voltage across the switch times current through the switch, is often insufficient to insure breakdown of the insulating film that tends to form on the switch contacts, especially when low cost switches are used.

Figure 2:
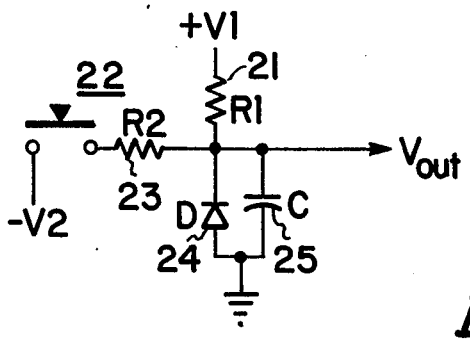
FIG. 2 is a schematic of one embodiment of the invention.

The circuit of FIG. 2 is an embodiment of the invention for insuring that sufficient energy, using a higher voltage, is switched to overcome the effect of the insulating layers on the switch contacts. Although the physics of switch contacts is not well understood, it appears that higher currents have better cleaning effects but cause carbonizing, heating, and welding. On the other hand, higher voltages are better for breaking down moisture and dirt film but cause arcing and contact pitting.

For purposes of illustration, it is assumed that the voltage levels to be switched at the output are plus V1 and ground. The logic input, or output from the switching circuit, is coupled to the V1 voltage by a resistor 21. The switch 22 is returned to a negative voltage, minus V2, via a second resistor 23. The circuit output voltage is clamped to ground, or zero potential, by a diode 24 which has a parallel capacitance 25 which may be the capacitance of the diode or the capacitance of the diode plus an added capacitor.

When the switch 22 is closed, the voltage across the switch contacts is the sum of V1 and V2, which can be made sufficiently large to insure that the switching breaks down the insulating film. After the switch 22 is closed, the output voltage approaches V2 and the diode 24 conducts when the output voltage is below ground by an amount equal to the small forward voltage drop of the diode. Discharge of the capacitor 25 through the switch 22 via the resistor 23 insures that the high voltage across the switch 22 will be maintained for a sufficient amount of time to insure that the insulating film is broken down.

Figure 3:
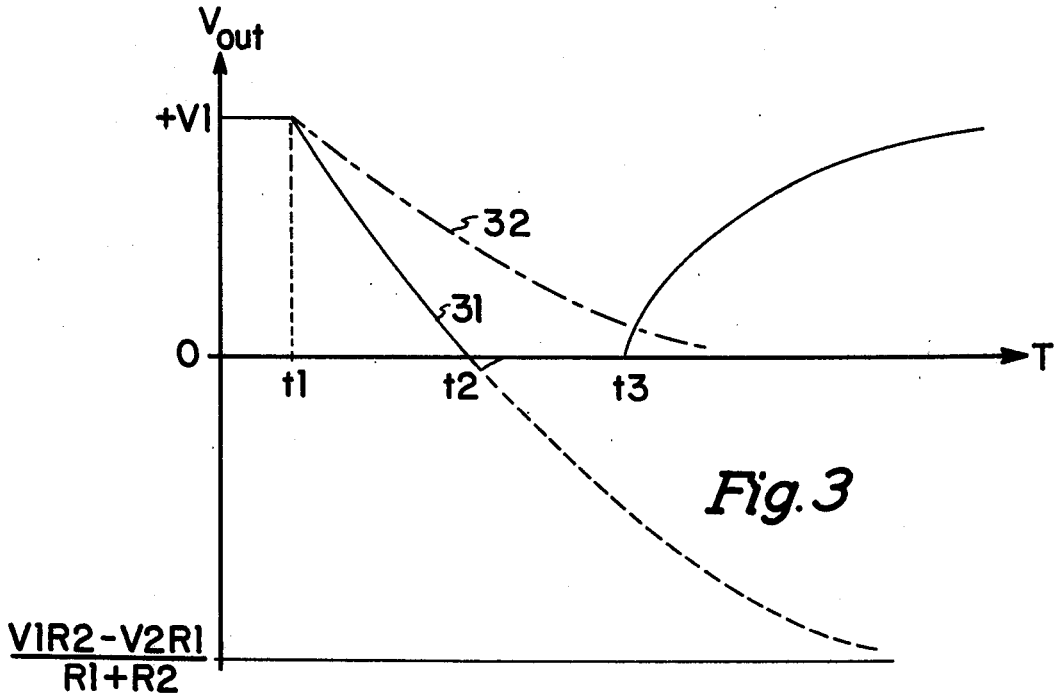
FIG. 3 is a graph of output voltage versus time of the embodiment shown in FIG. 2.

FIG. 3 shows the general shape of the output voltage characteristics. The switch is closed at time $t_1$ and opened at time $t_3$. Up to the time of closing the switch, the output voltage ($V_{out}$) remains at V1 because the impedance at the output is very large compared to the value of the resistor R1.

At time $T_1$, the closing of the switch causes the output to drop toward (V1R2+V2R1)/(R1+R2). The capacitor, charged initially to V1, tends to resist the change in output voltage so that the output voltage curve 31 is given by $$V_{out} = \frac{(V1\ R2 - V2\ R1)\ (1 - \exp(-t/R_pC))}{(R1 + R2) + V1\ \exp(-t/R_pC)}$$

for $t_1 \leqslant t \leqslant t_2$ and $R_p = R1R2/(R1+R2)$.

At time $t_2$, the diode 24 conducts, clamping the output voltage to ground.

At $t_3$, when the switch is opened, the output voltage rises from ground toward V1 as given by $$V_{out} = V1(1\text{-}\exp(\text{-}t/R1C)) \text{ for } t \geqslant t_3.$$

The time scale for the falling and rising edges of the output voltage is not necessarily the same. The fall time (slope of 31) is exaggerated for purposes of illustration. The capacitance of diodes is low so the time constant of the circuit is small. Additional capacitance can be provided for noise (or grass) suppression with a corresponding increase in the time constant of the circuit.

In another embodiment of the invention, the diode may be eliminated. using a value of R1 equal to R2 times the ratio of V1 and V2, viz., $$R1 = R2\ V1/V2,$$

the output voltage will approach zero because of the voltage divider action of R1 and R2. A broken line 32 shows the increase in fall time if the capacitor is discharged toward ground instead of (V1R2+V2R1)/(R1+R2).

The voltage at one terminal of the switch is V2 and at the other, V1 when the switch is open. The voltage V1 appears because no current is drawn through either R1 or R2. When the switch is closed, the sum of V1 and V2 remain across the terminals until the insulating film breaks down because the resistance across the switch is large compared to R1 and R2 until the contacts are connected. As current begins to flow through the switch, it rises quickly to an initial value of (V1+V2)/R2 because of the initial charge on the capacitor. Since R2 can be made arbitrarily small, the initial current through the switch can be made quite high. The integral of the product of the large voltage drop across the switch times the current through the switch is the energy switched. For example, assuming arguendo that the voltage decreases and the current increases linearly during the short interval that the switching action takes place, then $$i_s(t) = (V1+V2)(t/t_2)/R2 \text{ and}$$

$$v_s(t) = (V1+V2)(1 - t/t_s)$$

where $i_s(t)$ = switching current as a function of time,
$v_s(t)$ = switching voltage as a function of time, and
$t_s$ = required for switching action.

The energy switched, $U_s$, is $$U_s = \int_0^{t_s} v_s(t)\ i_s(t)dt$$

which can be shown to be $$U_s = (t_s16)(V1+V2)^2/R2.$$

This value is generally called switching loss because it represents energy dissipated in the switch. The amount of loss, as far as adjustable, is one of the trade-off for reliability. Reduction of the loss allows contamination build-up whereas an increase of loss reduces switch life. Each switch has an optimum value.

For an illustrative comparison of the energy switched in the invention to that of the prior art circuit of FIG. 1, let

R = R1 = 47K
R2 = 1K
V1 = +5V
−V2 = −12V.

Since the energy of the prior art circuit is $$U'_{s'} = (t_s/6)V1^2/R$$

and since $t_s$ is assumed to be the same in both cases, then $U_s/U'_{s'} = 543.32$.

Thus, the energy switched by the invention is more than 500 times greater than the prior art circuit.

Various modifications in the circuits disclosed and illustrated to explain the concepts and modes of practicing the invention might be made by those of ordinary skill in the art within the principle or scope of the invention as expressed in the appended claims.

What is claimed is:

1. The combination comprising:
switch means selectively operable to couple first and second terminals electrically;
first, second, and third voltage level means for providing three voltage levels such that said first voltage level is highest, said second voltage level is lowest, and said third voltage is intermediate between said first and second voltage levels;
output terminal means;
resistance for coupling said first voltage level means to said output terminal means;
means for coupling said second voltage level means to said first terminal of the switch means;
impedance means for coupling said second terminal of the switch means to the output terminal means; and
diode means for coupling said third voltage level means to said output terminal means in a direction whereby the voltage at said output terminal means is not less than said third voltage level.

2. The combination comprising:
switch means selectively operable to couple first and second terminals electrically;
first, second, and third voltage level means for providing three voltage levels such that said first voltage level is highest, said second voltage level is lowest, and said third voltage level is intermediate between said first and second voltage levels;
output terminal means;
first resistance means for coupling said first voltage level means to said output terminal means;
means for coupling said second voltage level means to said fist terminal of the switch means; and
second resistance means for coupling said second terminal of the switch means to the output terminal means, said second resistance means having a value related to the value of the first resistance means whereby said output terminal voltage is substantially equal to said third voltage level when said switch is operated.

3. The circuit as claimed in claim 2 including capacitor means coupled between said output terminal and said third voltage level.

* * * * *

UNITED STATES PATENT OFFICE
CERTIFICATE OF CORRECTION

PATENT NO. : 4,011,464

DATED : March 8, 1977

INVENTOR(S) : Anthony Drea Robbi

It is certified that error appears in the above-identified patent and that said Letters Patent are hereby corrected as shown below:

Column 3, line 58, Change "$(t/t_2)$" to --$(t/t_s)$--.

Column 3, line 69, Change "$(t_s 16)$" to --$(t_s/6)$--.

Column 4, line 58, Change "fist" to --first--.

Signed and Sealed this

Third Day of May 1977

[SEAL]

*Attest:*

RUTH C. MASON
*Attesting Officer*

C. MARSHALL DANN
*Commissioner of Patents and Trademarks*